US005844203A

United States Patent [19]

Chasen et al.

[11] Patent Number: 5,844,203

[45] Date of Patent: Dec. 1, 1998

[54] COMBINED SWITCH ACTUATOR AND SIGNAL LIGHT TRANSMITTER FOR AN IRON

[75] Inventors: James E Chasen, West Haven; Peter A Czerner, Trumbull, both of Conn.

[73] Assignee: Black & Decker Inc., Newark, Del.

[21] Appl. No.: 539,933

[22] Filed: Oct. 6, 1995

[51] Int. Cl.[6] ..... D06F 75/26; H01H 9/00

[52] U.S. Cl. ..... 219/256; 38/74; 200/314

[58] Field of Search ..... 219/256, 257, 219/258–259, 245, 507; 38/74, 75, 79, 80, 81, 82, 93; 200/520, 523, 314, 345, 341, DIG. 47

[56] References Cited

U.S. PATENT DOCUMENTS

| | | | |
|---|---|---|---|
| 2,033,897 | 3/1936 | Jenkins et al. | 219/507 |
| 2,476,612 | 7/1949 | Lobdell | 219/507 |
| 4,022,993 | 5/1977 | Shattuck | 200/314 |
| 4,163,883 | 8/1979 | Boulanger | 200/314 |
| 4,203,101 | 5/1980 | Townsend | 340/635 |
| 4,347,428 | 8/1982 | Conrad et al. | 219/251 |
| 4,517,757 | 5/1985 | Asada et al. | 38/88 |
| 4,673,798 | 6/1987 | Contri et al. | 219/225 |
| 4,686,352 | 8/1987 | Nawrot et al. | 219/250 |
| 4,692,589 | 9/1987 | Borsari et al. | 219/251 |
| 4,743,736 | 5/1988 | Albinger, Jr. et al. | 219/250 |
| 4,885,443 | 12/1989 | Simcoe et al. | 200/314 |
| 5,250,139 | 10/1993 | Hall | 156/379 |
| 5,280,145 | 1/1994 | Mosier et al. | 200/314 |
| 5,285,037 | 2/1994 | Baranski et al. | 200/314 |
| 5,290,998 | 3/1994 | Couch et al. | 219/247 |
| 5,376,799 | 12/1994 | Schamber et al. | 250/441.11 |
| 5,545,865 | 8/1996 | Gotou | 200/341 |
| 5,568,367 | 10/1996 | Park | 200/314 |

FOREIGN PATENT DOCUMENTS

| | | | |
|---|---|---|---|
| 86759 | 8/1983 | European Pat. Off. . | |
| 63-43700 | 2/1988 | Japan . | |
| 1497310 | 7/1989 | U.S.S.R. | 38/82 |

OTHER PUBLICATIONS

1. Use and Care Book, "Advanced System Automatic Shut–Off Irons" For Models F630S, F615A, F612 and F610SA, Black & Decker, 1993, 16 pages.

*Primary Examiner*—Teresa J. Walberg
*Assistant Examiner*—Raphael Valencia
*Attorney, Agent, or Firm*—Barry E. Deutsch

[57] ABSTRACT

A switch actuator for an electric iron comprises a one-piece member with a first end stationarily connected to the housing of an iron and a second end adapted to be depressed by a user. The second end extends through an aperture in the housing. The second end is located in front of a control switch of the iron inside the housing. The second end has a transparent section to transmit light from a signal light inside of the housing to outside of the housing. The first end of the member is interlockingly captured by a receiving area of the housing without use of additional fasteners.

16 Claims, 3 Drawing Sheets

FIG. 4
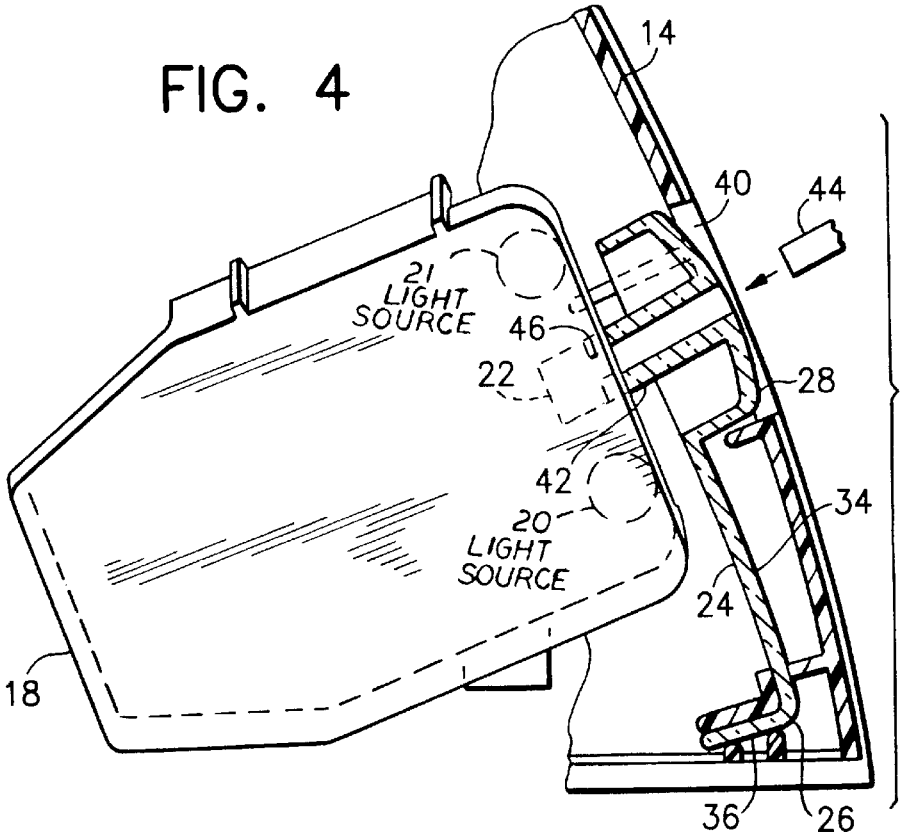
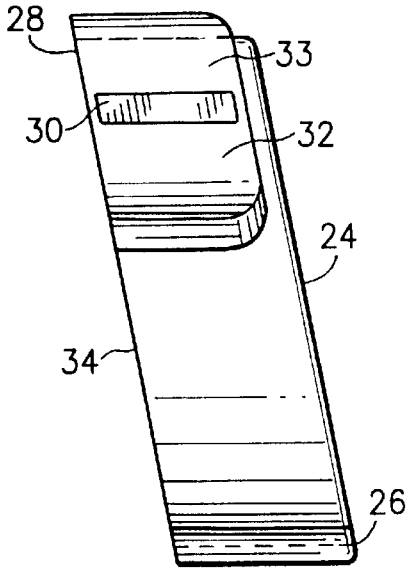
FIG. 5

COMBINED SWITCH ACTUATOR AND SIGNAL LIGHT TRANSMITTER FOR AN IRON

BACKGROUND OF THE INVENTION

1. Field of the Invention

The present invention relates to household appliances and, more particularly, to an iron with an improved actuator button.

2. Prior Art

U.S. Pat. No. 4,743,736 discloses an iron with two illuminated indicators and a separate start switch. U.S. Pat. No. 4,692,589 discloses an arm moved by a button to depress a reset pin. Black & Decker (U.S.) Inc. has sold irons under the model designations of an F600 series that has a Push On Button/Light on its handle. The Button/Light has a translucent push button member located over a light bulb and a metal leaf spring that biases the push button member at an undepressed position. Black & Decker (U.S.) Inc. has also sold irons under the model designation of an F800 series that has a stationary translucent window with a light bulb behind it at a side rear end of the iron and, a separate depressible button located below the window. The depressible button comprises a metal leaf spring and a plastic button member that is biased by the metal leaf spring at an undepressed position. Other U.S. patents that disclose irons with various switches or steam generators include the following:

U.S. Pat. No. 4,673,798 U.S. Pat. No. 4,686,352 U.S. Pat. No. 4,203,101 U.S. Pat. No. 4,347,428 U.S. Pat. No. 4,517,757 U.S. Pat. No. 5,250,139 U.S. Pat. No. 5,290,998 U.S. Pat. No. 5,376,799

SUMMARY OF THE INVENTION

In accordance with one embodiment of the present invention, in an iron having a soleplate, a housing connected to the soleplate, and a control switch located inside the housing, the improvement comprises a one piece actuator having a first end stationarily connected to the housing and a second movable end extending through an aperture in the housing and located in front of the control switch to actuate the control switch when the second end is depressed.

In accordance with another embodiment of the present invention, in an iron having a soleplate, a housing connected to the soleplate, and control circuitry located inside the housing, the improvement comprises an actuator located inside and connected to the housing, the actuator having a button section extending through an aperture in the housing for depression by a user, the button section being suitably located to actuate a switch of the control circuitry when the button section is depressed by the user, the button section having a light transmitting section located in a path of a signal light of the control circuitry.

In accordance with another embodiment of the present invention, in an iron having a soleplate, a housing connected to the soleplate, and control circuitry located inside the housing, the improvement comprises a combined switch actuator and signal light transmitting member connected to the housing. The member is depressed by a user to actuate a switch of the control circuitry and transmits light from a signal light of the control circuitry to outside the housing.

BRIEF DESCRIPTION OF THE DRAWINGS

The foregoing aspects and other features of the invention are explained in the following description, taken in connection with the accompanying drawings, wherein:

FIG. 4 is a partial schematic cross-sectional view of some of the components shown in FIG. 3 with the actuator moved to a depressed position; and FIG. 5 is an elevational side view of the actuator shown in FIG. 3 taken from direction A.

DETAILED DESCRIPTION OF THE PREFERRED EMBODIMENT

Figure 1:
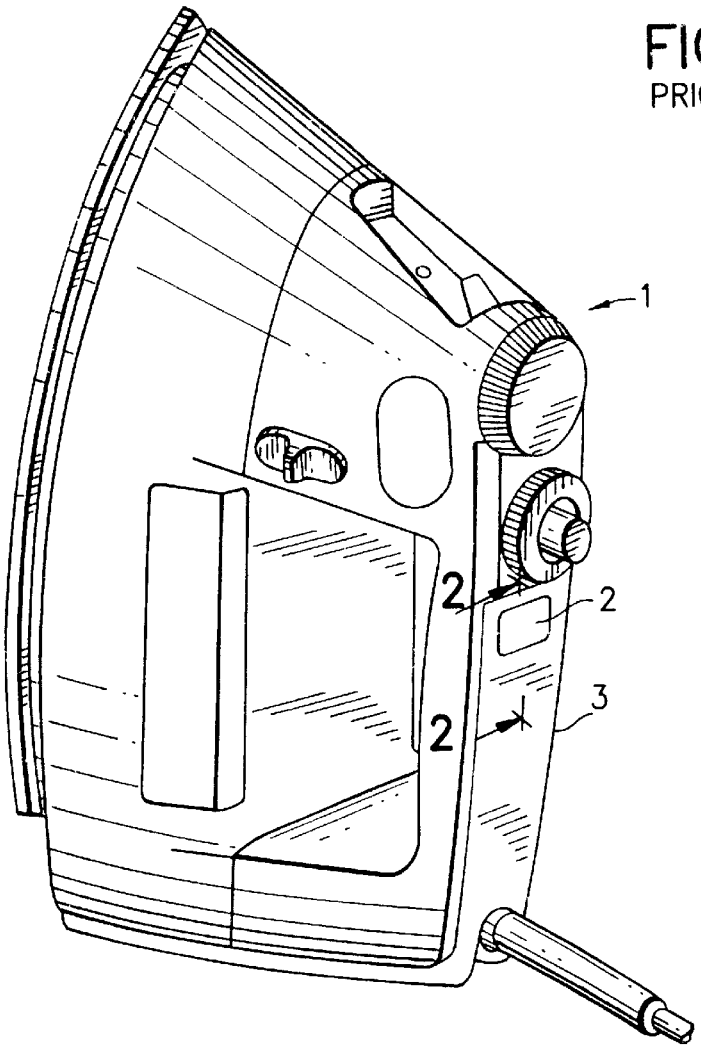
FIG. 1 PRIOR ART
FIG. 1 is a perspective view of an iron known in the prior art.
Figure 2:
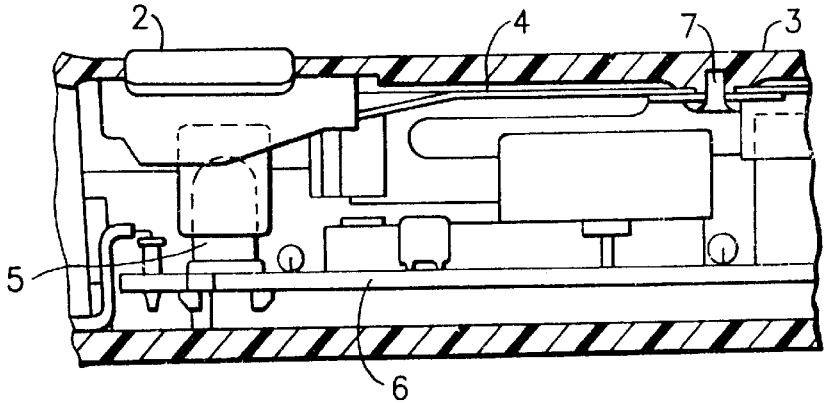
FIG. 2 PRIOR ART
FIG. 2 is a cross-sectional view of the handle of the iron shown in FIG. 1 taken along line 2—2.

FIGS. 1 and 2 show an iron 1 known in the prior art that has a depressible button 2 on its handle 3. The button 2 is biased by a metal leaf spring 4 towards its undepressed position. The button 2 is made of plastic translucent material. Two light bulbs 5 (only one of which is shown) connected to a circuit board 6 are located under the button 2. The leaf spring is fastened to the handle 3 by a fastener 7.

Figure 3:
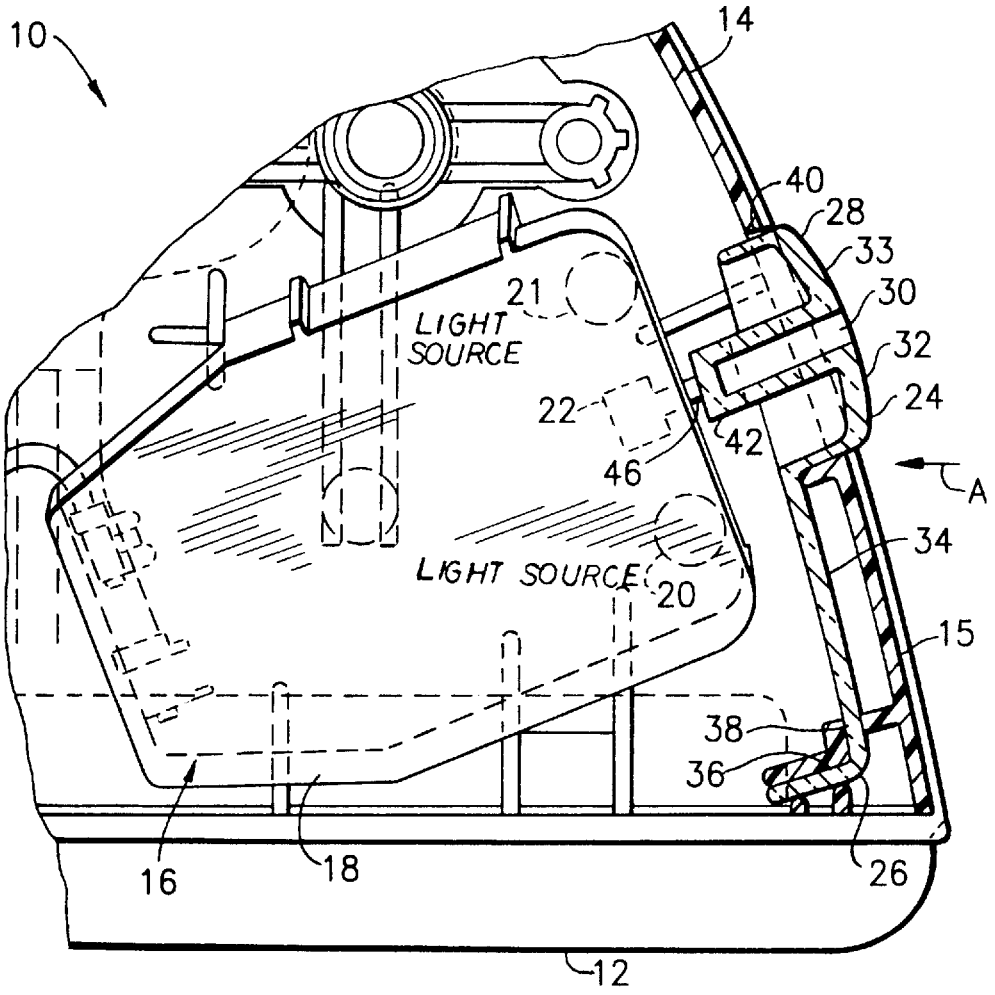
FIG. 3 is a partial schematic cross-sectional view of a portion of an iron incorporating features of the present invention at a rear end of the iron.

Referring to FIG. 3, there is shown a partial schematic cross-sectional view of a portion of an iron 10 incorporating features of the present invention. Although the present invention will be described with reference to the single embodiment shown in the drawings, it should be understood that the present invention may be embodied in various different forms of alternate embodiments. In addition, any suitable size, shape or type of elements or materials could be used.

The iron 10 includes a soleplate 12, a housing 14 and control circuitry 16. The housing 14 is attached to the soleplate 12 and encloses the control circuitry 16. The control circuitry 16 includes an automatic off module 18. In the embodiment shown, the module 18 is a time controlled module that turns the iron off after a predetermined or preset period of time, such as one hour after the iron is turned on. However, the module could have any suitable type of control circuitry. The module 18 includes light sources 20, 21, such as neon bulbs, and a switch 22. One of the two light sources 21 is provided to signal that electrical power is being supplied to the iron. The other light source 20 is provided to signal that the thermostat is being supplied with electricity for powering the heating element (not shown). In an alternate embodiment only one of the light sources need be provided to signal that the power is on. In another alternate embodiment, more than two light sources could be provided. The switch 22 is provided to reset the module 18 after the automatic off feature has been activated.

Referring also to FIG. 5, an actuator 24 of the iron 10 is shown. The actuator 24 is preferably comprised of a transparent plastic or polymer material. The actuator 24 has a first end 26 and a second end 28. The first end 26 has a general "L" shape. The second end 28 forms a push button section for the actuator. The second end 28 has a pocket 30 and two light transmitting areas 32, 33 located at the bottom and the top of the pocket 30. In an alternate embodiment, the pocket 30 need not be provided. In another alternate embodiment, more or less than two light transmitting areas could be provided. The rear of the pocket 30 forms a projection 42 at the back of the second end 28. Located between the two ends 26, 28 is an elongate center section 34. The center section 34 is deformable in a general cantilever fashion along its length.

As seen in FIG. 3, the housing 14 includes a receiving area 36 and a slot 38. The receiving area 36 is suitably sized and shaped to have the first end 26 of the actuator 24 stationarily located therein. The first end 26 extends out of the receiving area 36 through the slot 38. In the embodiment shown, the receiving area 36 and slot 38 are formed in the rear end cover 15 of the housing 14. However, the receiving area and slot could be formed in another area of the housing; not necessarily in the rear end cover 15. In order to insert the first end 26 into the receiving area 36, the actuator 24 is positioned inside the rear end cover 15 before connection of the cover to the rest of the housing. The first end 26 slides into the receiving area 36 and the rear end cover 15 is then connected to the rest of the housing to complete the capture of the first end 26 in the area 36. When the rear end cover 15 is attached to the rest of the housing, the entrances to the area 36 and slot 38 are blocked by a skirt of the iron. Thus, the first end 26 is interlockingly stationarily connected to the housing without direct use of fasteners between the actuator and the housing. The rear end cover 15 also has a side aperture 40 at its front end. The side aperture 40 is suitably sized and shaped to receive the second end 28 of the actuator 24. More specifically, the outer side of the second end 28 projects out of the housing at the aperture 40 in its unactuated position shown in FIG. 3. As seen in FIG. 5, the actuator 24 has a general angled shape relative to the first end 26. This is because the rear end of the housing 14, where the rear end cover is attached, has an angled shape.

As noted above, the module 18 has two lights 20, 21. The lights 20, 21 are located on opposite sides of the switch 22; one above and one below. The lower light transmitting area 32 on the actuator's second end 28 is located in a path of light from the lower light source 20 to transmit that light outside of the housing 14. The upper light transmitting area 33 is located in a path of light from the upper light source 21 to transmit that light outside of the housing 14. The light transmitting areas 32, 33 can function as a lens because the actuator 24 is comprised of transparent material. In an alternate embodiment, the actuator could be comprised of translucent material, or the areas 32, 33 could be separate transparent or translucent members that are fixedly connected to the rest of the actuator. The pocket 30 has been provided in order to receive an insert 44 (see FIG. 4) therein. The insert 44 is preferably an opaque member. The insert 44 insures that light from the two light sources 20, 21 is kept separate at the two light transmitting areas 32, 33. The insert is preferably permanently fixed to the actuator 24, such as by ultrasonic welding or snap-lock attachment. Alternatively, the insert need not be provided. The inside of the pocket 30 could be coated with a light blocking coating to prevent light at area 32 from traveling to area 33 or visa versa. There may be some cross-over or bleed through of light to the wrong area 32, 33, but such cross-over or bleed through is limited. Alternatively, any suitable means could be used to insure that the two areas 32, 33 each respectively transmit light from only one of the light sources 20, 21.

Referring also to FIG. 4, the module 18, housing 14 and actuator 24 are shown with the actuator 24 in an actuated or depressed position. In order to actuate the actuator 24, a user merely depresses the second end 28 further into the housing 14. The projection 42, in the unactuated position shown in FIG. 3, is located on or very close to an end of a switch button 46 of the switch 22. When the second end 28 of the actuator 24 is depressed, as shown in FIG. 4, the projection 42 depresses the switch button 46 to thereby actuate the switch 22. Because the first end 26 of the actuator 24 is interlockingly stationarily captured in the receiving area 36, the center section 34 of the actuator 24 deflects in a general cantilever fashion. Because the actuator 24 is made of a resilient deflectable material, when the user releases the second end 28, the actuator 24 springs back to its position shown in FIG. 3. In a preferred embodiment the actuator 24 proximate the second end 28 can be preloaded against the inside of the housing 14. When the switch 22 is actuated by the actuator 24, the module 18 is reset to allow the iron to function again. Thus, the switch 22 merely resets the automatic off module 18. In an alternate embodiment, the switch 22 could also control the ON/OFF feature of the iron irrespective of whether the automatic off feature of the module 18 caused the iron to automatically turn OFF.

In alternate embodiments, the actuator could have any suitable shape. However, the one-piece nature of the actuator 24 in combination with the integral light transmitting areas 32, 33 is a preferred embodiment. Any suitable means could be used to connect the actuator 24 to the housing 14. However, the interlocking stationary connection of the first end 26 in the receiving area 36 without the use of additional fasteners is also a preferred embodiment. The switch 22 could also have any suitable switch button or lever to be actuated by the back of the second end 28 of the actuator 24.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. In an iron having a soleplate, a housing connected to the soleplate, and a control switch located inside the housing, the improvement comprising:

a one-piece actuator having a first end stationarily connected to the housing and a second movable end extending through an aperture in the housing and located in front of the control switch to actuate the control switch when the second end is depressed, said second end forming a light transmitting section; and an independent source of light mounted in said housing in general axial alignment with the second end of said actuator and axially spaced from said actuator, said second end of said actuator transmitting light from inside said housing to outside the housing.

2. An iron in claim 1 wherein the light transmitting section is transparent.

3. An iron as in claim 1 wherein the light transmitting section comprises a lens.

4. An iron as in claim 1 wherein the first end is interlockingly connected to the housing in a receiving area of the housing without use of additional fasteners.

5. In an iron having a soleplate, a housing connected to the soleplate, and control circuitry located inside the housing, the improvement comprising:

a one-piece actuator located inside and connected to the housing, the actuator having a button section extending through an aperture in the housing for depression by a user and means for biasing the button section at an undepressed position, the button section being suitably located to actuate a switch of the control circuitry when the button section is depressed by the user, the button section having a light transmitting section located in a path of a signal light of the control circuitry; and an independent source for the signal light mounted in said housing in general axial alignment with the button section of said actuator and axially spaced from said actuator, said button section of said actuator transmitting light from inside said housing to outside the housing.

6. An iron as in claim 5 wherein the actuator has a first end stationarily connected to the housing, the actuator deflecting in a general cantilevered fashion when the user depresses the button section.

7. An iron as in claim 6 wherein the first end is interlockingly connected to the housing in a receiving area of the housing without use of additional fasteners.

8. An iron as in claim 5 wherein the light transmitting section is transparent.

9. An iron as in claim 5 wherein the light transmitting section comprises a lens.

10. In an iron having a soleplate, a housing connected to the soleplate, and control circuitry located inside the housing, the improvement comprising:

a combined switch actuator and signal light transmitting member connected to the housing, the member being depressed by a user to actuate a switch of the control circuitry and transmitting light from a signal light of the control circuitry to outside the housing; and an independent source of light mounted in said housing and axially spaced from said combined switch actuator and light transmitting member, said source of light including at least two separate light transmitting sources and said light transmitting member including at least two light transmitting sections and a pocket separating said light transmitting sections, a portion of said pocket being opaque.

11. An iron as in claim 10 further comprising an opaque insert located in the pocket.

12. An iron as in claim 10 wherein the member is a one-piece member.

13. An iron as in claim 12 wherein the member has a first end stationarily connected to the housing, the member deflecting in a general cantilevered fashion when the user depresses a button section of the member.

14. An iron as in claim 13 wherein the first end is interlockingly connected to the housing in a receiving area of the housing without use of additional fasteners.

15. An iron as in claim 10 wherein the light transmitting section is transparent.

16. An iron as in claim 10 wherein the light transmitting section comprises a lens.

* * * * *